US009234342B1

(12) United States Patent
Beesley et al.

(10) Patent No.: US 9,234,342 B1
(45) Date of Patent: Jan. 12, 2016

(54) HANDHELD POWERED CABLE-DRUM DRAIN CLEANING MACHINE

(71) Applicants: Daniel Joseph Beesley, Salt Lake City, UT (US); Jordan Roy Beesley, Salt Lake City, UT (US)

(72) Inventors: Daniel Joseph Beesley, Salt Lake City, UT (US); Jordan Roy Beesley, Salt Lake City, UT (US)

( * ) Notice: Subject to any disclaimer, the term of this patent is extended or adjusted under 35 U.S.C. 154(b) by 11 days.

(21) Appl. No.: 14/487,943

(22) Filed: Sep. 16, 2014

(51) Int. Cl.
*E03F 9/00* (2006.01)
*E03C 1/302* (2006.01)
*B08B 9/045* (2006.01)

(52) U.S. Cl.
CPC ..... *E03F 9/005* (2013.01); *B08B 9/045* (2013.01); *E03C 1/302* (2013.01)

(58) Field of Classification Search
CPC ..... E03C 1/302; E03F 9/002; E03F 9/005; B08B 9/027; B08B 9/04; B08B 9/043; B08B 9/0436; B08B 9/045
USPC ..... 15/104.31, 104.33
See application file for complete search history.

(56) References Cited

U.S. PATENT DOCUMENTS 1,807,549 A * 5/1931 Reber ..... B65H 75/40 15/104.33
2,278,067 A * 3/1942 Emery ..... E03F 9/005 15/104.33
2,318,172 A * 5/1943 Long ..... B23Q 1/0009 15/104.33
2,940,099 A * 6/1960 Kollmann ..... E03F 9/005 15/104.33
3,727,261 A * 4/1973 Levine ..... B23B 45/001 15/104.33
3,958,293 A * 5/1976 Irwin ..... E03F 9/005 15/104.33

* cited by examiner

*Primary Examiner* — Mark Spisich
(74) *Attorney, Agent, or Firm* — Angus C. Fox, III

(57) ABSTRACT

A hand-held drain cleaning machine which is of the type that employs a flexible snake that can be inserted into a waste line and rotated to remove a blockage, includes a drum in which the snake is coiled and a guide tube extending from a central front portion of the drum, through which the snake can be extended and retracted. An electric motor, which is coupled to the drum, provides rotational movement to the drum and the snake when AC line current is provided to the motor through an operator-activated switch located within a handle grip. The handle grip, which is secured to the electric motor, is preferably positioned directly above the machine' center of gravity. In addition, an extendable support, having a foot, is also secured to the electric motor and preferably positioned so that the foot is directly beneath the machine' center of gravity.

20 Claims, 3 Drawing Sheets

HANDHELD POWERED CABLE-DRUM DRAIN CLEANING MACHINE

FIELD OF THE INVENTION

The present invention relates to axially-rotatable drain cleaning cables, or snakes, that retract into a drum and, more specifically, to handheld, powered cable-drum drain cleaning machines.

BACKGROUND OF THE INVENTION

Portable electric rotary drain cleaners have been around for more than seventy years. U.S. Pat. No. 2,467,849 to John V. O'brien, et al. describes a device having a pistol-grip handle coupled to a hollow barrel, an electric motor assembly positioned in front of the handle below the barrel, a chuck at the distal end of the barrel that is coupled to the motor assembly via a gear drive, and a flexible cable that passes through the handle, enters the barrel, and exits through the chuck. An appropriate portion of the cable can be extended through the chuck opening and, with the chuck tightened so that it clamps the cable to the gear drive, the cable will be axially rotated when the motor assembly is activated.

U.S. Pat. No. 2,769,191 which issued to Robert G. Hunt, et al. In 1954 (some ten years later) discloses a Plumber's Tool, a similar machine having a rotating drum that houses an unused portion of the drain cleaning cable. U.S. Pat. No. 3,206,782 to John H. Larsen discloses a Plumber's Snake Device that improves on the device of the '191 patent. Though equipped with a unidirectional motor, the Larsen device provides the operator with a simple controller to effect change between feed and retraction while the motor is operating. In addition, the controller enables the operator to halt feed or retraction of the snake while the motor is operating. The device also automatically stops the feed when the free end of the snake encounters an abnormal obstruction in the pipe being cleaned. In addition, retraction of the snake is automatically stopped when it comes to a fixed stop. U.S. Pat. No. 3,224,024 to Robert G. Hunt discloses a portable powered plumber's snake having an alternative feed mechanism.

Most of the ultra-portable powered plumber's snakes incorporate what appears to be an electric drill motor. Realizing the limitations of such a device, U.S. Pat. No. 3,268,937 to Burton J. Bollinger has packaged such a portable unit in a box, while providing an external switch for the operator.

The Plumbers' Tool described in U.S. Pat. No. 3,609,788 to Mark F. Mier is a plumbers' flexible snake having a chuck through which the snake passes in and out, an adapter shell suitable for mounting on a motor or on a crank which releasably attaches to the rear of the container to afford a means for rotating the container, and a container adaptable for mounting various types of chucks.

U.S. Pat. No. 4,218,802 describes a Drain Cleaning Apparatus that utilizes a flexible snake which is inserted into a drain pipe and rotated so as to cut through a blockage or obstruction in the drain pipe. The apparatus includes a manually actuated chuck operable while the apparatus is in operation, for holding the snake relative to the apparatus, thus enabling the operator to feed the snake forceably into the drain pipe and into cutting engagement with an obstruction, and auxiliary means operable to lock the snake securely with respect to the apparatus so as to perm it the torque of the apparatus' drive motor to be applied to the snake.

U.S. Pat. No. 4,763,374 to Paul S. Kaye discloses a powered drain-cleaning implement of the type with a rotatable snake extendable for drain insertion. The device has a housing with a rear portion over the motor and a front portion terminating in a collar, a snake container rotatably supported in the front portion and having a forward tubular portion extending through the collar and ending in a distal opening where the snake is adjustably secured, a ring gear on the back of the container, and a pinion gear on the motor engaging the ring gear for high-torque rotation of the snake. The housing preferably covers the motor, gears and container. Its rear portion preferably has a handle and associated trigger for easy holding and operation.

A Portable Drain Cleaning Apparatus is disclosed in U.S. Pat. No. 4,956,889 to Karl L. Kirk, which is of the type employing a flexible snake which is rotated and inserted into a waste line to remove blockage. The apparatus includes a housing in which the snake is coiled and a guide tube extending from the housing and through which the snake passes for insertion into a waste line. A manually actuated sleeve assembly is provided on the guide for displacing resilient spring finger clamping elements into engagement with the snake to hold the snake against axial displacement relative to the housing during insertion and/or removal of the snake from the waste line and to clamp the snake against rotation relative to the guide tube and the housing during the drain cleaning operation. The sleeve assembly is removably retained on the guide tube, and the spring finger elements, the guide tube and the sleeve assembly engage with one another to alone removably support the spring finger clamping elements against axial and circumferential displacement relative to and radial separation from the guide tube. Upon removal of the tubular hand grip, the spring finger gripping elements are released for separation from the guide tube.

It will be noted that the drain cleaning device of the '849 Patent to O'brien, et al., as well as more modern drain cleaning devices, such as the device of the '889 Patent to Kirk, are derivatives of the Drain Cleaner that is the subject of the 1940 U.S. Pat. No. 2,284,939 to Remi C. Asnard. The Asnard patent discloses a hand-cranked drain cleaner which includes a plumbers' snake that is stored in a container and which has one end protruding through a central hole in the container. The snake, which can be extended and retracted through the hole, can also be rotated—along with the container—by rotating the hand crank.

A main problem with the foregoing devices is that they have what may be characterized as a pistol grip. Thus, using such a device is like holding a pistol with a thirty-pound weight suspended from the end of the barrel. Using conventional portable motorized drain cleaning machines can not only be tiring, but can result in soft tissue damage to the wrist, elbow and shoulder joints of the user.

SUMMARY OF THE INVENTION

The present invention provides a hand-held drain cleaning machine which is of a non-free-standing type (i.e., it is handheld and does not have a stable base on which it rests in an upright position) that employs a flexible snake that can be inserted into a waste line and rotated to remove a blockage. The machine includes a drum in which the snake is coiled and a guide tube extending from a central front portion of the drum, through which the snake can be extended and retracted. An electric motor, which is coupled to the drum, provides rotational movement to the drum and the snake when AC current is provided to the motor through an operator-activated switch. A handle grip, which is secured to the electric motor, is positioned, ideally, directly above the center of gravity of the machine. The operator-activated switch is located within the handle grip. An AC power cord provides power to the unit.

In addition, an extendable support, or leg, is also secured to the electric motor. The extendable monopod support has a foot that is positioned, ideally, directly beneath the center of gravity of the machine. As the snake is extended from the unit, a shift in the center of gravity occurs. Thus, the foot is ideally positioned directly beneath the center of the center-of-gravity range. As the machine is operated, the operator can hold the handle grip with, generally, the right hand. The snake can be manually extended or retracted by the operator's left hand. Optionally, a handle surrounding the guide tube can be used to engage a clutch having female threads match the snake's coil-to-coil spacing. When engaged, the snake will either extend or retract through the guide tube at a speed that is proportional to either the forward or reverse speed of the electric motor.

PREFERRED EMBODIMENT OF THE INVENTION

The invention will now be described with reference to the attached drawing figures. It should be understood that the drawings may not be drawn to exact scale and are intended to be merely illustrative of the invention.

The focus of the present invention is on the repositioning of handles, switches and supports for handheld cable-drum drain-cleaning machine that is powered by an electric motor. It should be emphasized that this patent applies to handheld cable-drum drain-cleaning machines of a non-free-standing type. In other words, these machines are handheld units, which do not have a stable base on which the machine can sit in an upright position. It must be maintained in a upright position by the user's grip. The focus is not on the redesign of the cable-drum assembly or the redesign of the drive system between the electric motor and the cable-drum assembly. For those features, this application relies on existing technology. Thus, U.S. Pat. Nos. 4,956,889 and 4,218,802 are entirely incorporated herein by reference.

Figure 1:
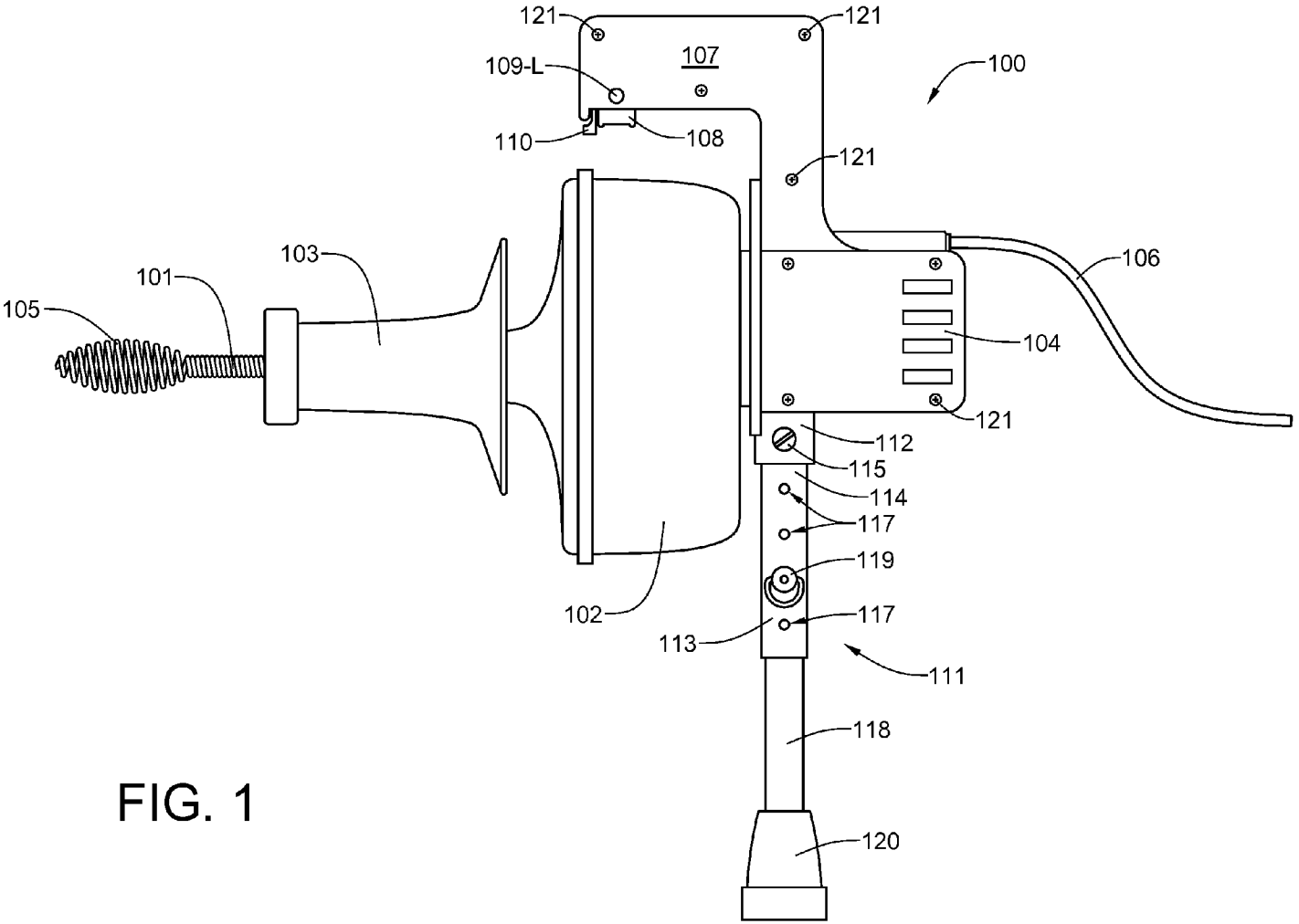
FIG. 1 is a left side elevational view of the improved handheld powered cable-drum drain-cleaning machine equipped with a first embodiment monopod.
Figure 2:
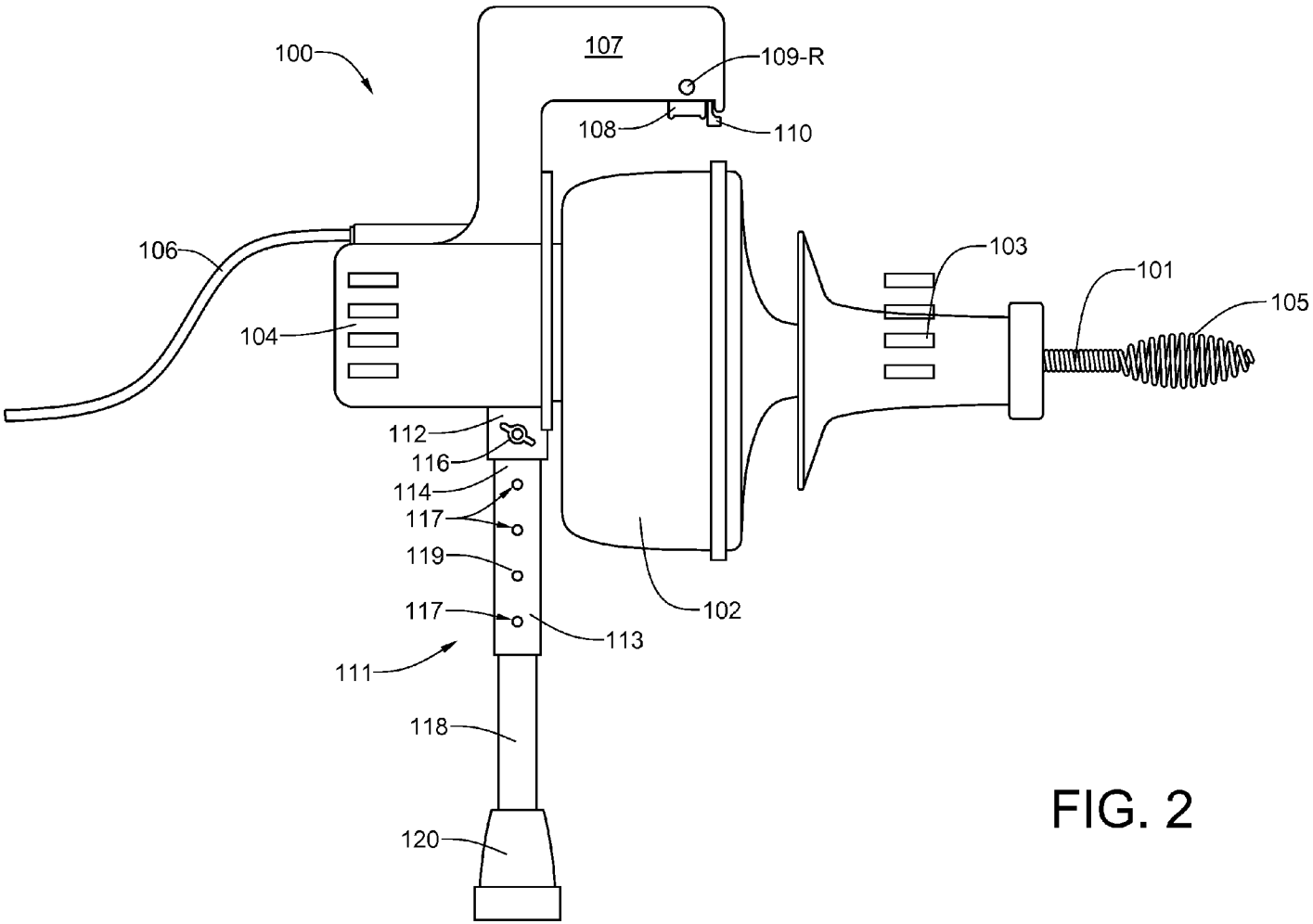
FIG. 2 is a right side elevational view of the improved handheld powered cable-drum drain cleaning machine of FIG. 1.

Referring now to FIGS. 1 and 2, an improved handheld powered cable-drum drain-cleaning machine 100 is of the type having a flexible snake 101 that can be inserted into a waste line and rotated to remove a blockage. The machine includes a drum 102 in which the snake 101 is coiled and a guide tube 103 extending from a central front portion of the drum 102, through which the snake 101 can be extended and retracted. The drum 102 and the snake 101 can be axially rotated by an electric motor located within a motor housing 104. The snake 101 has a head 105 at the forward end that is designed to remove blockages when the stake 101 is axially rotated. Although this particular embodiment of the drain-cleaning machine 100 is powered by an AC motor, to which AC current from an AC electrical outlet is provided through an AC power cord 106, it is also contemplated that the AC motor may be replaced with a DC motor and that a battery pack providing DC power can replace the incoming AC power. A handle grip 107, which is secured to the electric motor housing 104, is positioned, ideally, so that the center thereof is directly above the center of gravity of the drain-cleaning machine 100. An operator-activated switch 108 is located within the handle grip. The operator-activated switch 108 can provide variable speed control of the AC motor. A power-ON lock button 109-L or 109-R (109 generally) is provided on left and right sides of the handle so that a thumb of an operator's left or right hand can lock the operator-activated switch 108 in a power-ON state. It will be noted that a direction reversal switch 110 is adjacent the operator-activated switch 108. The rotational direction of the electric motor is reversed by moving the direction reversal switch 110 from one side of the machine to the other. In addition, an extendable monopod support 111 is also secured to the electric motor housing. The extendable monopod support 111 includes a collar 112 that is rig idly coupled to the motor housing 104, an outer tubular member 113 having an upper end 114 that slides into the collar 112 and is rigidly locked in place within the collar 112 by a retaining screw 115 and nut 116. The outer tubular member 113 is equipped with a plurality of equally-spaced apertures 117 that pass perpendicularly through the central axis of the outer tubular member 113. An inner tubular member 118, which slides within the outer tubular member 113, has a single aperture (not shown) that can be locked to one of the plurality of equally-spaced apertures 117 with a push pin 119. The lower end of the inner tubular member 118 has a rubber shoe 120 that is positioned beneath the center of gravity of the drain-cleaning machine 100. It should be understood that the outer tubular member 113 can be removed, along with the inner tubular member 118 and the attached rubber shoe 120 from the collar 112 in order to more compactly store the machine.

Still referring to FIGS. 1 and 2, it will be noted that the motor housing 104 and the handle grip 107 can be integrally joined as a single injection-molded piece. As a practical matter, the motor housing 104 and the handle grip 107 can be split vertically and be made of two mirror image pieces made of structural polymer plastic materials that are held together with screws 121. Such a configuration will enable the electric motor and the operator-activated switch 108 to be installed inside the motor housing and handle assembly.

Figure 3:
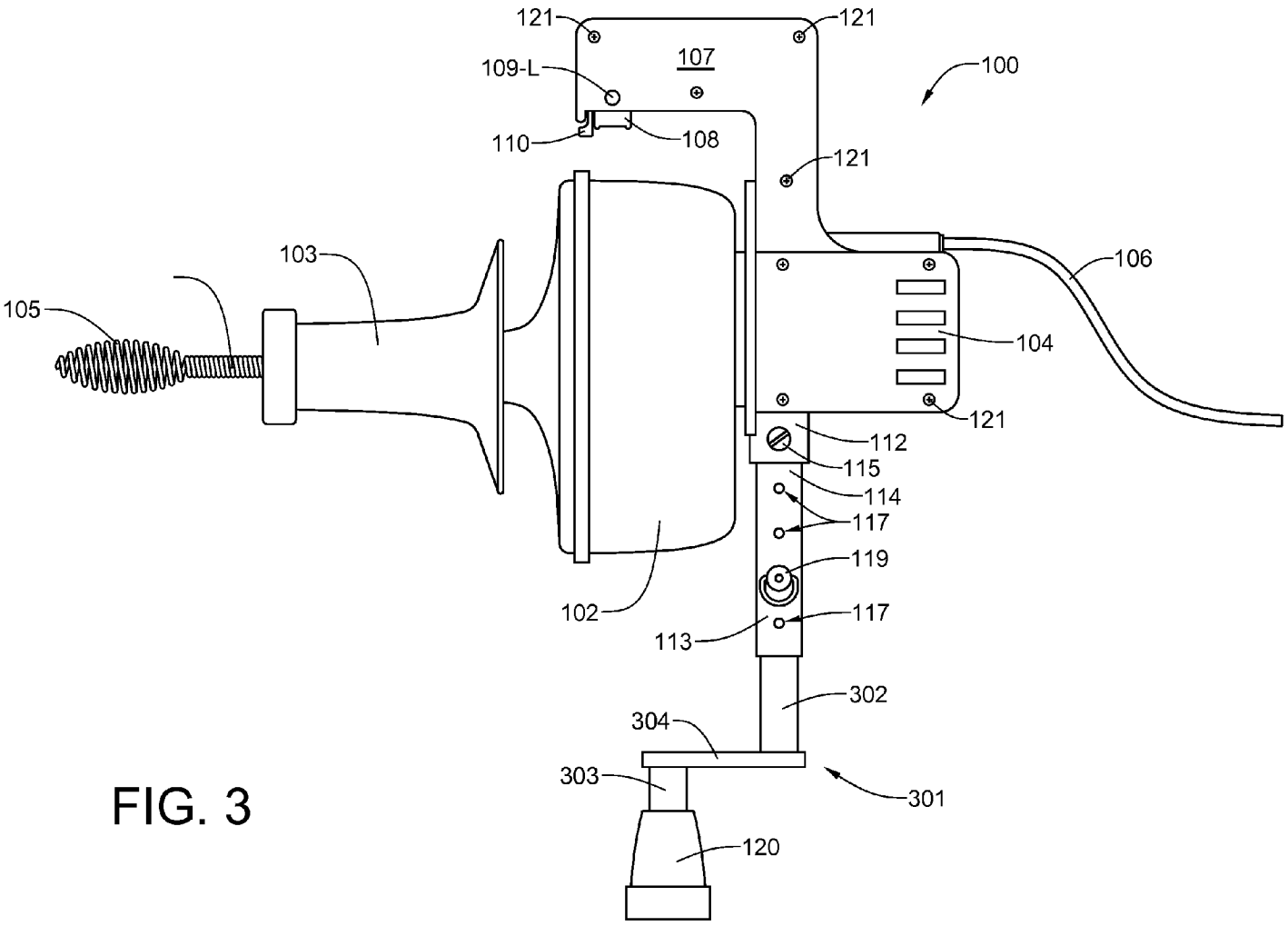
FIG. 3 is a side elevational view of the improved handheld powered cable-drum drain cleaning machine equipped with a second embodiment monopod.

Referring now to FIG. 3, the improved handheld powered cable-drum drain-cleaning machine 100 of FIG. 1 has been modified in such a way that the inner tubular member 118 has been replaced with a lower support member 301 that has a telescoping upper portion 302 that slides within the outer tubular member 113, a tubular lower portion 303, and a link portion 304 that rig idly interconnects the telescoping upper portion 302 to the tubular lower portion 303. A rubber shoe 120 slides over a lower end of the tubular lower portion 303.

Although only a single embodiment of the improved handheld powered cable-drum drain cleaning machine has been shown and described, it will be obvious to those having ordinary skill in the art that changes and modifications may be made thereto without departing from the scope and the spirit of the invention as hereinafter claimed.

What is claimed is:

1. An improved hand-held drain-cleaning machine of the type that employs a flexible snake that can be inserted into a waste line and rotated to remove a blockage, the machine including a drum in which the snake is coiled and a guide tube extending from a central front portion of the drum, through which the snake can be extended and retracted, the machine further including an electric motor enclosed in a motor housing, the motor providing rotational movement to the drum and the snake when power is provided to the electric motor through an operator-activated switch, wherein the improvement comprises:

a handle grip secured to the motor housing, said handle grip being positioned above a center of gravity of the machine, and said operator-activated switch being located within the handle grip; and an extendable monopod support secured to the motor housing, said monopod support being positioned below the center of gravity of the machine.

2. The improved hand-held drain-cleaning machine of claim 1, wherein said extendable monopod support has a foot that is positioned directly beneath the center of gravity of the machine.

3. The improved hand-held drain-cleaning machine of claim 2, wherein said foot is displaced in a forward direction from an upper portion of the monopod support.

4. The improved hand-held drain-cleaning machine of claim 1, wherein a center of said handle grip is positioned directly above the center of gravity of the machine.

5. The improved hand-held drain-cleaning machine of claim 1, wherein said operator-activated switch incorporates an ON-lock button.

6. The improved hand-held drain-cleaning machine of claim 1, wherein the operator-activated switch is located on an underside of the handle grip and near the front thereof so that it can be activated by an index finger of the operator.

7. The improved hand-held drain-cleaning machine of claim 1, wherein a lower inner tubular portion of the monopod support slides within an upper outer tubular portion of larger diameter, and said lower tubular portion can be locked within said upper tubular portion to provide a monopod support of a desired height.

8. The improved hand-held drain-cleaning machine of claim 7, wherein the upper outer tubular portion has multiple, vertically-spaced radial apertures, and the lower tubular portion has a single radial aperture that enables said lower tubular portion to be pinned to the upper tubular portion in one of several extensive configurations.

9. The improved hand-held drain-cleaning machine of claim 1, wherein said handle grip is parallel to the snake as it exits the guide tube.

10. The improved hand-held drain-cleaning machine of claim 1, wherein said operator-activated switch incorporates an ON-lock button on each side of the handle grip so that the switch can be placed in an ON-locked configuration with a thumb of either the operator's right or left hand.

11. An improved hand-held drain-cleaning machine comprising:

a flexible snake that can be inserted into a waste line and rotated to remove a blockage;

a drum in which the snake is coiled;

a guide tube extending from a central front portion of the drum, through which the snake can be extended and retracted;

an electric motor enclosed in a motor housing, the providing rotational movement to the drum and the snake when power is provided to the electric motor;

a handle grip secured to the motor housing, said handle grip being positioned above a center of gravity of the machine;

an operator-activated, spring-biased switch located within the handle grip, said operator-activated switch providing power to the electric motor only when depressed; and an extendable monopod support secured to the motor housing, said monopod support being positioned below the center of gravity of the machine.

12. The improved hand-held drain-cleaning machine of claim 11, wherein said extendable monopod support has a foot that is positioned directly beneath the center of gravity of the machine.

13. The improved hand-held drain-cleaning machine of claim 12, wherein said foot is displaced in a forward direction from an upper portion of the monopod support.

14. The improved hand-held drain-cleaning machine of claim 11, wherein a center of said handle grip is positioned directly above the center of gravity of the machine.

15. The improved hand-held drain-cleaning machine of claim 11, wherein said operator-activated switch incorporates an ON-lock button.

16. The improved hand-held drain-cleaning machine of claim 11, wherein the operator-activated switch is located on an underside of the handle grip and near the front thereof so that it can be activated by an index finger of the operator.

17. The improved hand-held drain-cleaning machine of claim 11, wherein a tubular lower portion of the monopod support slides within an upper tubular portion of larger diameter, and said lower portion can be locked within said upper portion to provide a monopod support of a desired height.

18. The improved hand-held drain-cleaning machine of claim 17, wherein the upper tubular portion has multiple, vertically-spaced radial apertures, and the lower tubular portion has a single radial aperture that enables said lower tubular portion to be pinned to the upper tubular portion in one of several extensive configurations.

19. The improved hand-held drain-cleaning machine of claim 11, wherein said handle grip is parallel to the snake as it exits the guide tube.

20. The improved hand-held drain-cleaning machine of claim 11, wherein said operator-activated switch incorporates an ON-lock button on each side of the handle grip so that the switch can be placed in an ON-locked configuration with a thumb of either the operator's right or left hand.

* * * * *